US006854370B1

(12) United States Patent
Sonntag

(10) Patent No.: US 6,854,370 B1
(45) Date of Patent: Feb. 15, 2005

(54) DEVICE FOR THE CROSS PERFORATION OF WEBS

(75) Inventor: Andreas Sonntag, Muenster (DE)

(73) Assignee: Windmoeller & Hoelscher, Lengerich (DE)

( * ) Notice: Subject to any disclaimer, the term of this patent is extended or adjusted under 35 U.S.C. 154(b) by 543 days.

(21) Appl. No.: 09/598,939

(22) Filed: Jun. 22, 2000

(30) Foreign Application Priority Data

Jul. 2, 1999 (DE) ..... 199 30 686

(51) Int. Cl.[7] ..... B26D 7/26; B26D 1/62; B26F 1/20

(52) U.S. Cl. ..... 83/345; 83/304; 83/564; 83/660; 83/678; 493/370

(58) Field of Search ..... 83/345, 346, 287, 83/288, 304, 305, 337, 344, 306, 315, 503, 563, 564, 660, 678; 493/370

(56) References Cited

U.S. PATENT DOCUMENTS

| | | | | | |
|---|---|---|---|---|---|
| 390,327 | A | * | 10/1888 | Wheeler | 83/563 X |
| 898,193 | A | * | 9/1908 | Davidson | 83/337 |
| 1,018,155 | A | * | 2/1912 | Bengough | 83/345 |
| 1,244,005 | A | * | 10/1917 | Von Pein | 83/337 |
| 2,482,118 | A | * | 9/1949 | Matthews | 83/305 |
| 2,748,863 | A | * | 6/1956 | Benton | 83/171 |
| 3,178,981 | A | * | 4/1965 | Paulson | 83/345 |
| 3,475,252 | A | * | 10/1969 | White | 83/337 X |
| 4,052,920 | A | * | 10/1977 | Dixon | 83/337 |
| 4,167,131 | A | * | 9/1979 | Habas et al. | 83/304 |
| 4,216,690 | A | * | 8/1980 | Bullock | 83/114 |
| 4,667,552 | A | * | 5/1987 | Calligarich | 83/660 X |
| 4,856,396 | A | * | 8/1989 | Brinkmeier et al. | 83/304 X |
| 5,386,752 | A | * | 2/1995 | Siegel | 83/660 X |
| 6,418,827 | B1 | * | 7/2002 | Bussey, III et al. | 83/304 |

FOREIGN PATENT DOCUMENTS

| | | |
|---|---|---|
| DE | 28 27 983 | 1/1979 |
| DE | 39 26 640 | 2/1991 |
| DE | 198 14 009 | 6/1999 |

* cited by examiner

*Primary Examiner*—Clark F. Dexter
(74) *Attorney, Agent, or Firm*—Jacobson Holman PLLC

(57) ABSTRACT

A device for the cross perforation of webs, preferably paper webs for producing sacks, comprises a rotatingly driven perforating blade and a grooved roller, both of which are mounted on a machine frame and between them passes the web to be perforated. To adjust the penetration depth of the teeth of the perforating blade into the ring grooves of the grooved roller, there is at least one adjusting device for changing the distance between the axes of rotation of the perforating blade and the grooved roller.

10 Claims, 1 Drawing Sheet

DEVICE FOR THE CROSS PERFORATION OF WEBS

BACKGROUND OF THE INVENTION

1. Field of the Invention

The invention relates to a device for the cross perforation of webs, preferably paper webs for producing sacks. Said device comprises a rotatingly driven perforating blade and a grooved roller, both of which are mounted on a machine frame and between them passes the web to be perforated.

2. Description of the Related Art

For example, to produce paper sacks, paper tubes are produced from one web or several layers of webs, which are guided simultaneously, by folding in the sides so that they overlap and then by cementing the overlapping regions. From these paper tubes are severed socalled tubular segments. These tubular segments are then further processed in the conventional manner into paper sacks by forming the bottoms.

In so doing, the tubular segments are severed from the previously produced tubular web by providing cross perforations at intervals over the tubular segments so that the tubular segments can be torn off, one after the other, from the tubular web by the tear off devices.

These tubular segments are usually stacked into packages and passed on for the purpose of further processing into sacks.

As a function of the thickness of the paper webs or the number of layers of the tubular web to be perforated, the teeth of the perforating blade must descend deeper or less deeply into the grooved roller. Furthermore, it is desirable that for the purpose of feeding the perforated web, the perforating blade and the grooved roller be spaced so far apart that feeding does not cause a problem.

SUMMARY OF THE INVENTION

Therefore, the object of the invention is to provide a device of the class described in the introductory part, with which the penetration depth of the teeth of the perforating blade into the grooved roller can be set in accordance with the requirements.

The invention solves this problem by providing at least one adjusting device for changing the distance between the axes of rotation of the perforating blade and the grooved roller.

Devices for cross perforation are also usually provided with webs with cross perforations, from which tubular segments are torn for the purpose of producing sacks of different shapes. It must also be possible to adjust the spacing between the cross perforations in accordance with the different shapes. Such an adjustment is only possible, however, if the perforating blades can be changed in accordance with the varying width so that the perforating blades pass over the external cylinder of varying diameter. Thus, the enveloping curve of the perforating blade must be adjusted as a function of the length of the segment. This adjustment also necessitates that the position of the grooved roller be adjusted, because the distance between the axes will vary. A preferred embodiment of the invention includes an adjusting device that provides another adjustment so that the perforating blade can be exchanged as a function of such a wider width.

Another preferred embodiment includes an additional adjusting device that provides a fine adjustment of the penetration depth of the teeth of the perforating blade into the grooves of the grooved roller. This adjusting device makes it possible to coordinate the rotating perforating blade with the grooved roller such that webs of different thicknesses or different layers can be perforated in the desired manner. Single layered webs must, for example, be perforated when so-called staggered sacks are to be produced and have already been merged with flat webs provided with cross perforations into a multilayered web before the formation of the tube. It is especially necessary to be able to make adjustments for webs of different thicknesses, when multilayered tubular webs are to be perforated.

Preferably the fine adjustment covers such a wide range of adjustment that the perforating blade and the grooved roller can be disengaged so that it is possible with the design of the machine to feed the web to be perforated with ease between the perforating blade and the grooved roller.

Preferably each adjusting device comprises eccentric shafts that can be locked into position and pivot mounted on the machine frame.

Another preferred embodiment provides that the grooved roller can be pivot mounted on two guide levers, which are pivot mounted on the sides members of the frame and whose identical angle of swing can be adjusted by an eccentric shaft, which serves to make the coarse adjustment.

The eccentric shaft, which serves to make the coarse adjustment, can penetrate aligned window cutouts of both guide levers and rest against identical sides of these window cutouts.

Preferably the eccentric shafts in the window cutouts exhibit a play that facilitates their insertion. This play of the eccentric shaft in the window cutout can be preferably compensated for with a set screw, between which and the bracing point on the window cutout the eccentric shaft is fixed in position.

Another preferred embodiment provides that the guide levers be mounted so as to swivel on a shaft, which is offset on the machine frame and whose purpose is to make the fine adjustment.

Finally the bearings of the perforating blade and the grooved roller can be provided in support members, which can be slid transversely in the machine frame, thus providing a device for moving the supporting members sideways. This embodiment accounts for the circumstance that it may be necessary to move the perforating blade and the related grooved roller sideways.

One embodiment of the device is explained below in detail with reference to the drawing.

DETAILED DESCRIPTION OF THE PREFERRED EMBODIMENTS

Figure 1:
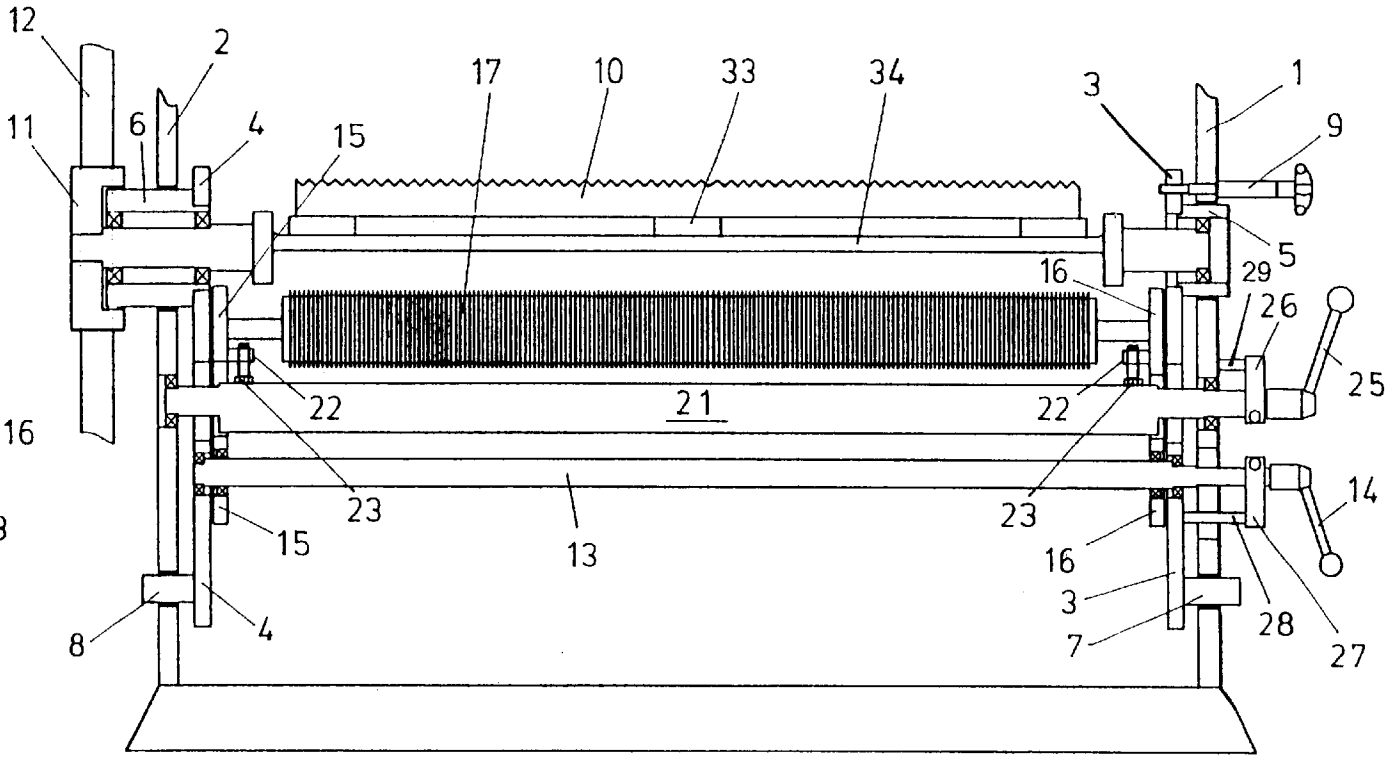
FIG. 1 is a schematic drawing of a front view of the device for cross perforating webs.

The plate-shaped side members 1, 2 of the machine frame hold plate-shaped supporting members 3, 4. The top areas of these supporting members are rigidly connected to aligned pipe pieces 5, 6, which can be moved into these fitted passages of the side members 1, 2. The bottom areas of the supporting members 3, 4 exhibit cones 7, 8, which also penetrate the appropriate passages of the side members 1, 2. For the purpose of reinforcement, the supporting members 3, 4 can be connected together by means of traverses (not illustrated). To be able to adjust the supporting members sideways, a shaft piece 9, which is provided with a control knob, is mounted on the side member 1 so that it can rotate, but not slide axially. The end region of the shaft piece is provided with a thread and is screwed into a tapped hole of the supporting member 3 so that by actuating the control knob the supporting members 3, 4 can be moved sideways relative to the side frames 1, 2.

A perforating blade is pivot mounted by means of roller bearings (not shown) in the pipe pieces 5, 6 which are rigidly connected to the supporting members 3, 4. The perforating blade 10 is equipped with a sawtooth-like cutting edge. A belt pulley 11, which can be driven by a belt or toothed belt 12, is keyed on the shaft journals of the rotatable perforating blade 10. The shaft journals project beyond the pipe piece.

Mounted on the supporting members 3, 4, is an eccentric shaft 13, which serves to make the fine adjustment and whose right end penetrates the right side frame 1 in a borehole. On the end an actuating lever 14 is mounted on the eccentric shaft 13 for the sake of adjusting the same. Two guide levers 15, 16 are mounted on the eccentric shaft 13 so as to swivel. The upper ends of the guide levers exhibit end-sided shaft journals of a grooved roller 17, which can be freely rotated. The grooved roller 17 is provided with ring grooves, into which the teeth of the perforating blade 10 can penetrate. In the center region between the mounting of the grooved roller 17 and the mounting of the eccentric shaft 13, the guide levers 15, 16 are provided with a somewhat rectangular window-like passage 20. This passage 20 is penetrated by an eccentric shaft 21, which can be rotated in the side members 1, 2 as shown in the drawing. Set screws 23, whose expanded dish shaped heads rest against the eccentric shaft 21 and which enclose between themselves and one side of the window cutouts 20 the eccentric shaft, are screwed into bent down brackets 22 of the guide levers 15, 16.

Figure 2:
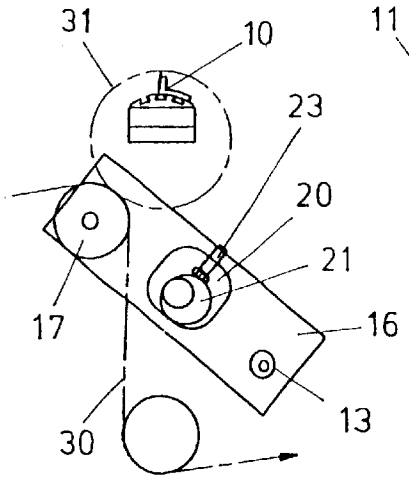
FIG. 2 depicts the positioning of the grooved roller in guide levers, which can be adjusted by two eccentric shafts.

The eccentric shaft 21 exhibits, as evident from FIG. 2, significant eccentricity so that as the eccentric shaft turns the perforating blade 10 engages and disengages with the grooved roller.

Following pre-adjustment by means of the eccentric shaft 21, a fine adjustment of the penetration depth of the perforating blade 10 into the ring grooves of the grooved rollers 17 can be made by rotating the eccentric shaft 13, exhibiting less eccentricity.

The eccentric shaft 21, serving the purpose of coarse adjustment, can be rotated by means of an actuating lever 25, which is fastened on its shaft journal penetrating the side frame 1.

The respective eccentricity, which is set by means of the eccentric shafts 13, and 21, can be fixed into position by means of shims 26, 27. The shim 26 is connected to the side frame 1 using a holding member 29, whereas the shim 27 exhibits a holding member 28, which penetrates the side frame 1 in a passage and is fastened to the supporting member 3.

FIG. 2 is a schematic drawing of the passage of the web 30 to be perforated through the device. The turning circle of the perforating blade 10 is shown by an enveloping curve 31.

The perforating blade 10 is mounted in the conventional manner by means of blade carriers 33 on the blade shaft 34.

Through a suitable choice of blade carriers 33, the effective diameter of the enveloping curve of the blades can be adjusted to the segment lengths of the web to be perforated. The adjustment can be made by installing wider or narrower perforating blades or also by adjusting the blade carriers 33 to the radial distance of the perforating blade cutting edges from the the axis of rotation.

The invention being thus described, it will be apparent that the same may be varied in many ways. Such variations are not to be regarded as a departure from the spirit and scope of the invention, and all such modifications as would be recognized by one skilled in the art are intended to be included within the scope of the following claims.

What is claimed is:

1. A device for cross perforation of webs comprising:

a pair of side frame members;

a rotatingly driven blade shaft mounted to said side frame members and extending therebetween, a perforating blade mounted to said blade shaft;

a guide lever pivot-mounted on each of said side frame members, each guide lever including a substantially identical window cutout;

a grooved roller mounted to said guide levers and extending therebetween, and spaced at a distance from said perforating blade to perforate a web passing between said grooved roller and said perforating blade;

a first eccentric shaft which extends through said window cutouts and cooperates with said guide levers to change the distance between said grooved roller and said perforating blade, the eccentricity of the eccentric shaft moving the grooved roller toward the blade to a position that causes the blade to periodically engage with the grooved roller as the blade shaft turns to provide cross-perforations of said web at spaced intervals; and a second eccentric shaft pivotally mounted to said guide levers for adjusting a penetration depth of teeth of said perforating blade into grooves of said grooved roller.

2. The device as set forth in claim 1, wherein said perforating blade is exchangeable such that a wider or narrower perforating blade may be mounted to alter a radial distance of the perforating blade cutting edges from an axis of rotation of said blade shaft, thereby changing an effective diameter of an enveloping curve of said blade for different segment lengths of the web being perforated.

3. The device as set forth in claim 1, wherein said blade is mounted to said blade shaft using a blade carrier that spaces the blade from the blade shaft, an effective diameter of an enveloping curve of said blade being set to segment lengths within the web being perforated by a suitable choice of blade carrier.

4. The device as set forth in claim 1, wherein said window cutouts are in alignment and an angle of swing of said two guide levers is identical and set through adjustment of said first eccentric shaft within said window cutouts.

5. The device as set forth in claim 1, further comprising a pair of spaced supporting members respectively connected to said pair of side frame members, said supporting members being transversely adjustable relative to said side frame members.

6. The device as set forth in claim 1, wherein said first eccentric shaft has an actuation lever for adjustment thereof.

7. The device as set forth in claim 1, wherein said second eccentric shaft has an actuating lever for adjustment thereof.

8. The device as set forth in claim 1, wherein an eccentricity of said first eccentric shaft is greater than an eccentricity of said second eccentric shaft.

9. The device as set forth in claim 1, wherein said first eccentric shaft rests against correlating sides of said two window cutouts.

10. The device as set forth in claim 9, wherein each of said guide levers includes a bracket through which a set screw is mounted, said set screws holding said first eccentric shaft against the correlating sides of said window cutouts.

* * * * *